United States Patent [19]

Hammersand

[11] 4,264,843

[45] Apr. 28, 1981

[54] MAGNETRON FILAMENT ASSEMBLY

[75] Inventor: Fred G. Hammersand, East Petersburg, Pa.

[73] Assignee: RCA Corp., New York, N.Y.

[21] Appl. No.: 79,254

[22] Filed: Sep. 27, 1979

[51] Int. Cl.[3] ..... H01J 25/50

[52] U.S. Cl. ..... 315/39.51; 313/331; 313/337; 315/39.75

[58] Field of Search ..... 315/39.51, 39.75, 39.53, 315/39.67; 313/341, 345, 331, 337

[56] References Cited

U.S. PATENT DOCUMENTS

| | | | |
|---|---|---|---|
| 3,287,597 | 11/1966 | Smith | 315/71 |
| 3,493,810 | 2/1970 | Valles | 315/39.51 |
| 4,066,928 | 1/1978 | Van Besouw et al. | 315/39.51 |
| 4,105,913 | 8/1979 | Yamano et al. | 315/39.51 |
| 4,177,402 | 12/1979 | Ishida | 315/39.51 |

*Primary Examiner*—Saxfield Chatmon, Jr.

*Attorney, Agent, or Firm*—Eugene M. Whitacre; Dennis H. Irlbeck; Vincent J. Coughlin, Jr.

[57] ABSTRACT

A magnetron includes an evacuated envelope having a sealing flange attached thereto, a filament electrode within the envelope and an anode electrode surrounding the filament electrode. One end of the filament electrode is electrically connected to a filament flange assembly. The other end of the filament electrode is connected to a filament post assembly which is insulated from the filament flange assembly. The filament flange assembly has a radially projecting, substantially flat annular sealing flange extending therefrom. The annular sealing flange of the filament flange assembly is hermetically joined to the envelope. Electrical connections to the filament electrode are made by means of a pair of substantially rectangular terminals having a flat contact surface attached to the filament flange assembly and the filament post assembly respectively.

9 Claims, 4 Drawing Figures

PRIOR ART

MAGNETRON FILAMENT ASSEMBLY

BACKGROUND OF THE INVENTION

This invention relates to a magnetron, and more particularly to an improved construction of the filament assembly of a large power magnetron having a ceramic-metal envelope.

Magnetrons are used as ultra-high frequency oscillators for use in microwave ovens or the like. Usually, in the case of industrial microwave ovens, the magnetron is capable of generating useful continuous radio frequency (rf) power in the range of 10 to 30 kilowatts (kw) at very high efficiency. The RCA 8684 Large Power Magnetron shown as 10 in FIG. 1 is an example of such a prior art magnetron which is useful as a 915-MHz, 30 kw rf power source in industrial processing applications. In the operation of such a magnetron it is important that the temperature of any external part of the tube should not exceed certain design limits which are in the range of 100° C. maximum for the metal surfaces and 150° C. maximum for the ceramic insulators. Since the filament current during typical operation is in the range of about 100 amperes at a filament voltage in excess of about 10 volts, external forced air cooling of the filament-cathode terminal contact surface 14 and the filament terminal contact surface 16 is required for safe operation. Since the terminal contact surfaces 14 and 16 are formed by nesting together cylindrical or cup-shaped metal flanges of the filament assembly, electrical connections between an external filament power supply (not shown) and the cylindrical terminal contact surfaces 14 and 16 are made by means of dissimilar coaxial connectors (not shown) secured to the contact surfaces. The coaxial connector which attaches to the filament terminal contact surface 16 also provides an air intake port for directing the air flow around the contact surface 16. This connector is designed to exhaust the air flow toward the filament-cathode terminal contact surface 14 to provide cooling thereto. The coaxial connector which attaches to the filament-cathode terminal contact surface 14 includes a molded rf suppressor to reduce rf leakage. Both of the coaxial connectors described above are extra accessories that increase the cost of the magnetron and make mounting of the magnetron into the equipment unnecessarily complex and time consuming.

SUMMARY OF THE INVENTION

The novel magnetron includes an evacuated envelope having a sealing flange attached thereto, a filament electrode within the envelope and an anode electrode surrounding the filament electrode. One end of the filament electrode is electrically connected to a filament flange assembly. The other end of the filament electrode is connected to a filament post assembly which is insulated from the filament flange assembly. The filament flange assembly has a radially projecting substantially flat annular sealing flange extending therefrom. The annular sealing flange of the filament flange assembly is hermetically joined to the envelope sealing flange.

DETAILED DESCRIPTION OF THE PREFERRED EMBODIMENT

Figure 2:
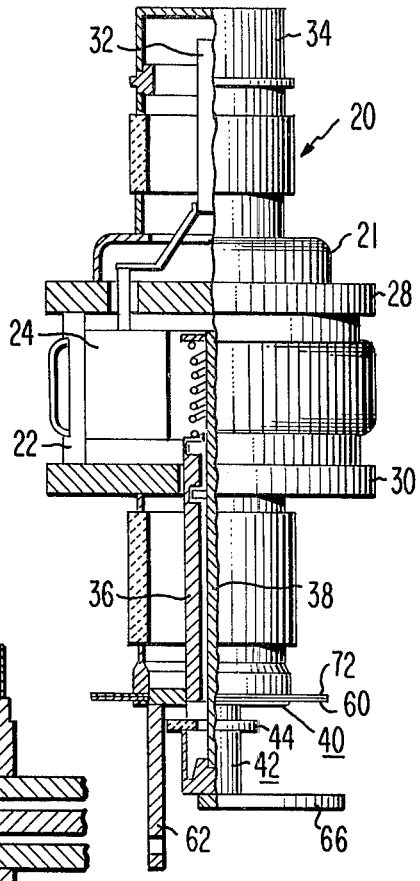
FIG. 2 is a partially cut away elevation view of a magnetron embodying the present invention.

Referring to FIG. 2, a preferred embodiment of the magnetron utilizing the present novel filament structure is generally designated as 20. The magnetron 20 comprises an evacuated ceramic-metal envelope 21 having therein an anode cylinder 22 provided with a plurality of radial vanes 24 secured to the inner wall of the anode cylinder. At the center of the anode cylinder 22 is a filament assembly 26. Magnetic pole pieces 28 and 30 are disposed on the opposite ends of the anode cylinder. An antenna 32 extends through the magnetic pole piece 28 between the space in which the vanes 24 are located and an output cap 34. The filament assembly 26 includes conductors 36 and 38 which extend through the center of the other magnetic pole piece 30. The conductor 36 is a hollow cylindrical member which is attached to a filament flange assembly 40, while the rod-like conductor 38 terminates in a filament post assembly 42 which is insulated from the flange assembly 40 by standoff ceramic 44.

Figure 3:
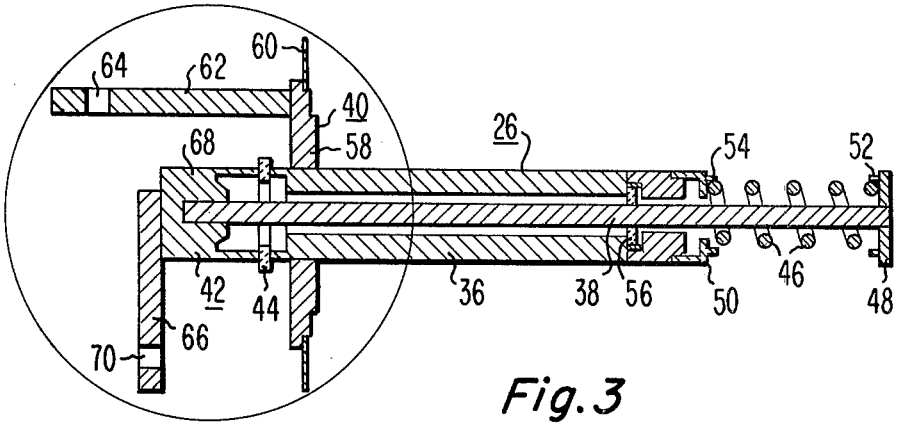
FIG. 3 is a sectional view of the filament assembly of the present invention.

FIG. 3 shows an enlarged view of the filament assembly 26 utilized in the magnetron 20 shown in FIG. 2. As shown in FIG. 3, the filament assembly 26 comprises a helical filament electrode 46 acting as the cathode electrode and a pair of disc shaped end shields 48 and 50. The end shields 48 and 50 are positioned at opposite ends of the filament 46 and are provided with confronting projections 52 and 54, respectively. The opposite ends of the filament 46 are welded to the projections on the end shields 48 and 50. One end shield 48 is connected to the rod-like conductor 38 which extends through an opening in the center of the other end shield 50. The hollow conductor 36 is secured to the lower surface of the end shield 50. Concentricity and alignment of the rod-like conductor 38 within the hollow conductor 36 is maintained by means of a centering insulator 56, preferably made of a high alumina ceramic material.

As described above, the conductor 36 is attached to the filament flange assembly 40, e.g., by brazing. The filament flange assembly 40 includes a base plate 58 having a substantially flat annular base sealing flange 60 brazed to one surface thereof. A flat strip electrical terminal 62 is attached to the opposite surface of the base plate 58. The electrical terminal 62 has a substantially rectangular cross section with an aperture 64 extending therethrough. The aperture 64 facilitates attaching a first lugged filament lead (not shown) from a filament power supply (not shown) to the terminal 62. The terminal 62 is aligned parallel to the longitudinal axis of the magnetron 20 and is preferably made of a metal having good thermal and electrical conducting properties, such as copper.

Electrical filament connection to the conductor is provided by means of an electrical terminal 66 which, together with a post support 68, comprises the filament post assembly 42. The terminal 66 is similar in structure and material to the terminal 62 and has an aperture 70 therethrough to facilitate attaching a second lugged filament lead (not shown) thereto. Terminal 66 is disposed perpendicular to the longitudinal axis of the magnetron 20 and extends away from the terminal 62 to insure adequate separation between the terminals 62 and 66. The filament assembly 26 is hermetically joined to the magnetron 20 preferably by heliarc welding the periphery of the annular sealing flange 60 to the periphery of a substantially flat, mating sealing flange 72 (shown in FIG. 2) of the envelope 21. The use of the flat sealing flanges 60 and 72 obviates the need to rely on the coaxial terminal connectors required by the cup-shaped flanges of the prior art type of magnetron discussed above.

Figure 1:
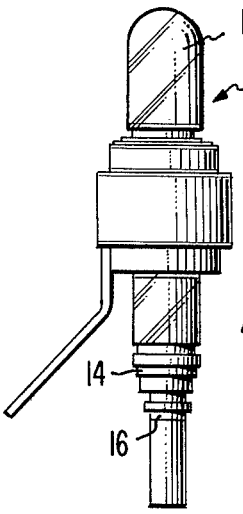
FIG. 1 is a elevation view of a prior art magnetron.

The novel filament assembly 26 including terminals 62 and 66 simplifies the installation of the magnetron 20 into both the production test facility and into the users equipment by permitting the filament leads to be bolted to the flat contact surface of terminals 62 and 66. This simplified structure eliminates the need for expensive and cumbersome coaxial connectors, at least one of which incorporates a channel for circulating forced air as required by the cylindrically shaped prior art filament terminals 14 and 16 shown in FIG. 1. Cooling of the filament assembly 26 including the filament terminals 62 and 66 in the above described embodiment is achieved by directing a source of air directly onto the exposed portion of the filament assembly 26 without the need for special terminal connectors.

Figure 4:
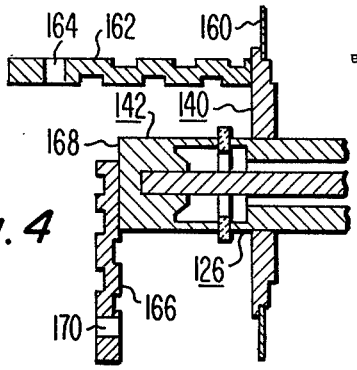
FIG. 4 is a fragmentary view of a modification of the filament assembly within the circle 4 of FIG. 3.

A second embodiment of the filament assembly, generally designated 126 is shown in FIG. 4. The structural elements of the filament assembly 126 are identical to the similarly enumerated elements of the filament assembly 26 shown in FIG. 3, except that the first digit of each number is increased by one hundred to identify the embodiment. As shown in FIG. 4, a pair of corrugated electrical terminals 162 and 166 are attached to the filament flange assembly 140 and the filament post assembly 142, respectively. The corrugated terminals 162 and 166 have a greater surface area than the terminals 62 and 66 shown in FIG. 3 and therefore dissipate heat more efficiently than the terminals 62 and 66.

I claim:

1. In a magnetron of the type including an evacuated envelope having a sealing flange attached thereto, a filament assembly including a filament electrode within said envelope, and an anode electrode surrounding said filament electrode, the improvement comprising, said envelope sealing flange being a substantially flat, radially extending member, said filament assembly further including a filament flange assembly electrically connected to one end of said filament electrode, said filament flange assembly having a base plate with a radially projecting, substantially flat annular sealing flange extending therefrom, said annular sealing flange being hermetically joined to said substantially flat envelope sealing flange, said filament flange assembly including a first electrical terminal means, and a filament post assembly, insulated from said filament flange assembly, said filament post assembly being electrically connected to the other end of said filament electrode, said filament post assembly including a second electrical terminal means.

2. A magnetron according to claim 1 wherein said annular sealing flange is hermetically joined to said envelope sealing flange by means of heliarc welding around the periphery of said flanges.

3. A magnetron according to claim 1 wherein each of said first electrical terminal means and each of said second electrical terminal means includes a substantially flat contact surface.

4. A magnetron according to claim 3 wherein each of said first and said electrical terminal means has a hole therethrough to facilitate attaching a lugged filament lead thereto.

5. A magnetron according to claim 3 wherein each of said first and second electrical terminal means has a substantially rectangular cross-section.

6. A magnetron according to claim 3 wherein each of said first and second electrical terminal means includes a corrugated portion to facilitate cooling thereof.

7. a magnetron according to claim 3 wherein said first electrical terminal means is aligned substantially parallel to the longitudinal axis of said magnetron.

8. A magnetron according to claim 3 wherein said second electrical terminal means is aligned substantially perpendicular to the longitudinal axis of said magnetron.

9. A magnetron according to claim 3 wherein each of said first and second electrical terminal means comprises a copper terminal attached to the filament flange assembly and the filament post assembly, respectively, of said magnetron.

* * * * *